US010788167B2

(12) United States Patent
Treurniet et al.

(10) Patent No.: US 10,788,167 B2
(45) Date of Patent: Sep. 29, 2020

(54) RETROFIT LIGHTING ASSEMBLY

(71) Applicant: SIGNIFY HOLDING B.V., Eindhoven (NL)

(72) Inventors: Theodoor Cornelis Treurniet, Best (NL); Jean-Luc Constant Octave Massage, Mol (BE); Jacobus Wilhelmus Vallen, Oss (NL); Mark Eduard Johan Spikes, Waalre (NL); Frank Van Zon, Retie (BE)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/608,965

(22) PCT Filed: Apr. 26, 2018

(86) PCT No.: PCT/EP2018/060684
§ 371 (c)(1),
(2) Date: Oct. 28, 2019

(87) PCT Pub. No.: WO2018/202527
PCT Pub. Date: Nov. 8, 2018

(65) Prior Publication Data

US 2020/0182414 A1 Jun. 11, 2020

(30) Foreign Application Priority Data

May 1, 2017 (EP) ..... 17168897

(51) Int. Cl.
*F21K 9/275* (2016.01)
*F21V 15/01* (2006.01)
(Continued)

(52) U.S. Cl.
CPC ..... *F21K 9/275* (2016.08); *F21K 9/278* (2016.08); *F21S 4/20* (2016.01); *F21S 8/026* (2013.01); *F21V 15/01* (2013.01)

(58) Field of Classification Search
CPC ..... F21K 9/275; F21K 9/278; F21V 15/01; F21S 8/026; F21S 4/20
See application file for complete search history.

(56) References Cited

U.S. PATENT DOCUMENTS 9,574,751 B1 2/2017 Eubanks et al.
2010/0172133 A1 7/2010 Liu
(Continued)

FOREIGN PATENT DOCUMENTS

CN 104344241 A 2/2015
DE 44 33 862 C1 3/1996
(Continued)

*Primary Examiner* — Joseph L Williams
(74) *Attorney, Agent, or Firm* — David J. Piotrowski

(57) ABSTRACT

A lighting assembly adapted to be mounted in a lighting fixture is provided. The lighting assembly comprises comprises a first reflector, a second reflector and at least two sidewall parts, a first fastening arrangement adapted to secure the first reflector to in at least one sidewall part, and a second fastening arrangement adapted to secure the second reflector to at least one sidewall part. The first reflector, the second reflector and the at least two sidewall parts are adapted to be arranged in the lighting fixture and secured to each other such that they define sidewalls of a four-sided cavity. Further, junctions between the first reflector, the second reflector and the at least two sidewall parts are arranged to be at the corners of the four-sided cavity when the first reflector, the second reflector and the at least two sidewall parts are arranged in the lighting fixture. Each one of at least two of the first reflector, the second reflector and the at least two sidewall parts comprises a support surface adapted to support the lighting assembly in the lighting
(Continued)

fixture and to be arranged at different sides of the four-sided cavity when the first reflector, the second reflector and the at least two sidewall parts are arranged in the lighting fixture. Further, the light engine is arranged to emit light out of the four-sided cavity. Thereby, a lighting assembly that is easier to install is achieved.

15 Claims, 7 Drawing Sheets

(51) Int. Cl.

| | |
|---|---|
| ***F21S 8/02*** | (2006.01) |
| ***F21K 9/278*** | (2016.01) |
| ***F21S 4/20*** | (2016.01) |

(56) References Cited

U.S. PATENT DOCUMENTS

| | | | |
|---|---|---|---|
| 2012/0140461 | A1 | 6/2012 | Pickard |
| 2012/0262902 | A1 | 10/2012 | Pickard et al. |
| 2014/0167620 | A1 | 6/2014 | Chobot |
| 2015/0049476 | A1 | 2/2015 | Hsia et al. |
| 2016/0131350 | A1 | 5/2016 | Li et al. |
| 2016/0245467 | A1 | 8/2016 | Lee et al. |
| 2016/0286619 | A1 | 9/2016 | Roberts et al. |

FOREIGN PATENT DOCUMENTS

| | | | |
|---|---|---|---|
| WO | 2015136110 | A1 | 9/2015 |
| WO | 2016200149 | A1 | 12/2016 |

RETROFIT LIGHTING ASSEMBLY

CROSS-REFERENCE TO PRIOR APPLICATIONS

This application is the U.S. National Phase application under 35 U.S.C. § 371 of International Application No. PCT/EP2018/060684, filed on Apr. 26, 2018, which claims the benefit of European Patent Application No. 17168897.1, filed on May 1, 2017. These applications are hereby incorporated by reference herein.

FIELD OF THE INVENTION

The present invention generally relates to the field of lighting assemblies adapted to be mounted in lighting fixtures.

BACKGROUND OF THE INVENTION

Fluorescent tube luminaries are widely used for illumination of e.g. commercial office spaces, schools, and lab facilities. Such luminaries are often arranged in a dropped ceiling, i.e. a secondary ceiling hung below the main, structural ceiling. A dropped ceiling may consist of a metal grid structure defining regularly spaced cells, e.g. having the dimensions of 2×4, 2×2 or 1×4 feet, (600×1200 mm, 600×600 mm or 300×1200 mm) which cells can be filled with tiles or panels so as to provide a flat surface hiding the space above the dropped ceiling.

A fluorescent tube luminaire may be accommodated in a cell of the dropped ceiling. In general, the luminaire may comprise a lighting fixture, or troffer, and optical elements enabling a desired optical performance. The luminaire may be recessed above the dropped ceiling grid and adapted to accommodate one or several fluorescent tubes. It is also common to provide light fixtures that fit the same space as a tile in order to facilitate installation.

Today, there is a growing demand for replacing fluorescent tubes with less energy consuming illumination devices, such as e.g. light emitting diode (LED) based illumination devices. Aspects of a kit for replacing fluorescent tubes in a fluorescent tube luminaire with a plate-like LED based lighting system are discussed in JP 2013/118063. That document describes a LED system that makes use of existing light fixtures, wherein the fluorescent tubes are replaced with two rods that are fixated to the sockets of the fixtures. A flat LED unit is then attached to the light fixture by means of L-shaped hooks that engage with the rods.

Although such LED-lighting systems can be used for replacing fluorescent tubes, there is still a need for improved kits that are easier to install in the lighting fixture.

WO2015136110 discloses a lighting assembly that can be retrofitted into an existing lighting fixture.

SUMMARY OF THE INVENTION

It would be advantageous to achieve a light engine that is easier to install or retrofit into an existing lighting fixture, particularly, a fluorescent lighting fixture located in a drop ceiling.

To better address this concern, a light engine, a lighting assembly and a method for mounting such assembly with the features of the independent claims is provided. The dependent claims define preferable embodiments.

Hence, according to a first aspect, a lighting assembly comprising a light engine is provided. The light engine is adapted to be mounted in the lighting assembly. The light engine having at least one LED and a reflector, the reflector being mechanically connected to a first reflector of the lighting assembly. The lighting assembly comprises a first reflector, a second reflector and at least two sidewall parts, a first fastening arrangement adapted to secure the first reflector to at least one sidewall part, and a second fastening arrangement adapted to secure the second reflector to at least one sidewall part. The first reflector, the second reflector and the at least two sidewall parts are adapted to be arranged in the lighting fixture and secured to each other such that they define sidewalls of a four-sided cavity. Further, junctions between the first reflector, the second reflector and the at least two sidewall parts are arranged to be at the corners of the four-sided cavity when the first reflector, the second reflector and the at least two sidewall parts are arranged in the lighting fixture.

According to a second aspect, a method for mounting a lighting assembly according to the second aspect is disclosed. The method comprises arranging the first reflector, the second reflector and the at least two sidewall parts in the lighting fixture and securing the first reflector, the second reflector and the at least two sidewall parts to each other by means of the first fastening arrangement and the second fastening arrangement such that junctions between the first reflector, the second reflector and the at least two sidewall parts are arranged at the corners of the four-sided cavity, securing the light engine to the first reflector, arranging the light engine to connect with the second reflector, and securing the light engine to the second reflector.

The lighting fixture (which also may be referred to as a troffer) may be originally intended for a fluorescent tube and may e.g. be installed above a grid in a dropped ceiling. The light engine and the lighting assembly according to the present aspects may be used for replacing the fluorescent tube and/or the optical elements that fit to the fluorescent tube in such a lighting fixture. The lighting fixture, the light engine and the lighting assembly may together form a luminaire. This may, in the context of this document, be understood as a retrofit lighting assembly. In particular, this may be considered as retrofit light engine if at a future time the first reflector, the second reflector and the at least two sidewall parts are to remain in-situ in the lighting fixture and a replacement light engine is installed. This enables a LED refurbishment kit to be supplied to allow the ongoing use of an already fitted retrofit lighting assembly. This bring sustainability advantages by producing less waste products if the light engine requires further replacement or simply when the user wishes to tailor the light emitted, for example by changing the light engine to one having a different color temperature or even full color changing. The light engine may also be fitted with sensors to allow an intelligent lighting assembly.

Furthermore, the light engine may be supplied to third party companies to allow them to market their own retrofit lighting assembly whilst still benefiting from a light engine that is accepted by the marketplace. It has been seen that the market appreciates the appearance of a voluminous luminaire.

By assembling the lighting assembly from a first reflector, a second reflector and at least two separate sidewall parts adapted to form junctions at the corners of the four-sided cavity and which may not necessarily be secured to each other until they are arranged in the lighting fixture, relatively large lighting assemblies can be arranged at lighting fixtures even though the available mounting space is relatively limited. Even though the mounted lighting assembly may be larger than e.g. the opening of the grid, i.e. have a length exceeding the length of the opening of the grid and a width exceeding the width of the opening of the grid, the lighting assembly may be inserted in the lighting fixture by arranging the first reflector, the second reflector and the at least two sidewall parts in the lighting fixture one by one and subsequently securing them to each other. In some embodiments the securing fixtures may be quarter-turn fixings. These are so called because only a quarter of a turn is required to open (or close) the fixing. This is much less than the amount of rotation required by a nut and bolt fixing or a screw fixing for example. This makes the quarter-turn fixings particularly suitable for use in areas where a fast assembly is advantagous.

The quarter-turn fastener may take the form of a central shank with pins protruding at the normal to the shank's central axis. If the fastening location comprises at least one slit the fastener may be inserted and then rotated by 90°. This rotation means that the pins will no longer be aligned with the slit and will prevent the fastener being pulled out of the slit. Therefore, the parts are joined together. It can be seen that such fasteners may also remove or reduce the required use of tools. This may mean that it is easier for the installer to quickly and safely join the individual parts of the lighting assembly to each other. Thereby, the use of individual and non assembled parts to construct a lighting assembly being slightly larger than the opening in the grid or the lighting fixture can be provided, and the installation of the lighting assembly may be facilitated.

In an embodiment, each one of at least two of the first reflector, the second reflector and the at least two sidewall parts comprises a support surface adapted to support the lighting assembly in the lighting fixture and to be arranged at different sides of the four-sided cavity when the first reflector, the second reflector and the at least two sidewall parts are arranged in the lighting fixture. Further, the light engine is arranged to emit light out of the four-sided cavity. The support surfaces of the first reflector, the second reflector and the at least two sidewall parts may engage with the lighting fixture or with the grid, such as the upper surface of a rim forming an opening of the grid, so as to support the lighting assembly in the lighting fixture. The support surfaces may be formed such that the total length and width of the lighting assembly may render it difficult to insert a mounted lighting assembly in the grid. Being able to mount such lighting assembly in pieces or modules further enables the lighting assembly to (at least almost) fully cover the opening in the cell of the grid. Thereby, the space above the grid of the dropped ceiling may be hidden for a viewer observing the ceiling.

The first reflector, the second reflector and the at least two sidewall parts being adapted to be secured to each other by the first fastening arrangement and the second fastening arrangement provide a modular lighting assembly comprising relatively few module components, whereby manufacturing, handling, packaging, transportation and mounting of the lighting assembly is facilitated.

A light engine may be arranged in the cavity between the first reflector, the second reflector and the at least two sidewall parts. When assembled, the first reflector, second reflector and the at least two sidewall parts may form a truncated pyramid, that is to say, a hollow gap may be formed at the dissection plane of the pyramid. The light engine preferably spans the gap at the top face of the truncated pyramid. The physical strength of the lighting assembly may be increased by securing the light engine across this gap. By adapting the shape and/or design of the first reflector, the second reflector and the at least two sidewall parts and hence the cavity, a desired illumination pattern in terms of spreading, direction, distribution angle etc. of light emitted out from the cavity may be achieved. This desired illumination pattern may be further tailored by the addition of a diffuser at a light exit window of the light engine. The desired illumination pattern may be yet furthered tailored by altering the shape and or depth of the light engine reflector.

The lighting assembly may e.g. be a retrofit lighting assembly. Such retrofit lighting assembly may e.g. be used for modification or conversion of a luminaire already in use. As an example, a luminaire may be converted from an incandescent, fluorescent, or high intensity discharge light source into a LED light source.

In the present specification, the term "junction" between the first reflector, the second reflector and the at least two sidewall parts may refer to an intersection or boundary between neighboring parts. The junction may e.g. extend from a position close to the rim of the cavity towards the top face, or gap, of the cavity. It will however be appreciated that neighboring first reflector, second reflector and at least two sidewall parts do not necessarily have to physically abut each other at the junction; the junction may just as well be defined as the point, line or area in which an imaginary extension of a first reflector and a second reflector and at least two sidewall parts meet, or intersect. Further, the term "corner" of the cavity may refer to the boundary or area where two neighboring sides of the four-sided cavity (at least almost) meet. Hence, the four-sided cavity comprises four corners.

According to an embodiment, the light engine may comprise a diffuser arranged to diffuse light emitted by the at least one LED. The diffuser may be adapted to spread the light that is output from the light engine so as to provide a soft, diffuse lighting. This may reduce the levels of glare to acceptable amounts as LEDs are well known to be extremely bright point light sources. Hence, by using a diffuser, the homogeneity and distribution of the illumination may be improved. Advantageously, the diffuser may be arranged to cover the light engine and/or the first reflector, the second reflector and the at least two sidewall parts so as improve the visual appearance of the lighting assembly. The diffuser may also be arranged to cover possible gaps between the lighting assembly and the grid or lighting fixture so as to achieve a ceiling having a relatively smooth and flat surface.

In an embodiment, the diffuser may be arranged to cover the light exit window of the light engine. The diffuser may directly abut the light engine or it may be spaced away from the light exit window of the light engine by a end caps.

According to an embodiment, installation of the light engine may facilitate the earthing of the parts of the lighting assembly. The driver that is part of the light engine is provided with an earthing wire which is connected to the relevant earthing location on the luminaire that was already in use. Therefore, this means that the light engine is earthed and as such, if the other parts of the assembly are electrically connected to the light engine, they will be earthed also.

According to an embodiment, the driver may be attached to the light engine at an angle from, and not directly attached to the light engine reflector. This may mean that an angled bracket, i.e., a bracket wherein the driver mounting face and the face that mounts to the light engine reflector are at an angle to each other, is used to attach the driver to the light engine.

According to an embodiment, the first fastening arrangement and/or the second fastening arrangement may comprise at least one protruding member being integrally formed with at least one of the first reflector, second reflector and the at least two sidewall parts and at least one receiving member being integrally formed with at least another of the aforementioned parts. The protruding member is adapted to engage with the receiving member in order to secure the first reflector, the second reflector and the at least two sidewall parts to each other. Thereby, facilitated fitting of the aforementioned parts may be achieved, as the number of required additional components or material such as screws, rivets etc. is reduced. The fastening arrangement according to the present embodiment allows the first reflector, second reflector and at least two sidewall parts to be secured to each other by simply inserting the protruding member into the receiving member upon/after the sidewall parts are arranged in the lighting fixture which may shorten the time required for installation.

The protruding member and the receiving member being integrally formed with the first reflector, the second reflector and the at least two sidewall parts also enables for a facilitated manufacturing process since they can be formed at the same time as the first reflector, the second reflector and the at least two sidewall parts are formed. Thereby, the number of steps and tools of the manufacturing process, as well as the bill of material, may be reduced.

It will however be appreciated that the first reflector, the second reflector and the at least two sidewall parts may be engaged to each other by means of other fastening arrangements which may be integrally formed with the aforementioned parts or form elements that are structurally distinct from these parts. Examples of other fastening arrangements may include clips, clamps, pins, magnets, screws, rivets, quarter-turn fasteners etc.

According to an embodiment, the protruding member of the fastening arrangement may comprise a tab and the receiving member may comprise a slit. The tab is adapted to be inserted in the slit and bent so as to secure the first reflector, the second reflector and the at least two sidewall parts to each other. By bending the tab, e.g. by hand or by means of pliers, a mechanical joint between the adjacent parts may be achieved. The bendable tab may also enable disassembling of the lighting fixture. By letting the tab assume its original shape, it may be removed from the slit and the first reflector, the second reflector and the at least two sidewall parts loosened from each other. The tab may be formed of a material and/or having a shape allowing the tab to be bent several times without being impaired by fatigue or wear, thereby allowing the lighting assembly to be repeatedly installed and removed. Being able to reuse or re-install a lighting assembly a plurality of times may advantageously facilitate e.g. repairing, service, and maintenance of the luminaire, the lighting assembly, the light engine, or the lighting fixture. The use of a bendable tab may also enable future adjustment of the illumination device, such as e.g. adjustment of the securing of the first reflector, the second reflector and the at least two sidewalls and the fitting tolerance in the lighting fixture.

The tab and the slit may also be adapted to allow for the dimensions of the cavity to be adjusted so as to improve the fitting in the lighting fixture and/or the grid. This may e.g. be achieved by varying the length of the tab that is inserted in the slit and bent. As an example, a cavity being formed of adjacent parts that are secured to each other by tabs being fully inserted in the slit may be smaller than a cavity whose adjacent parts are secured by tabs that are only partly inserted in the slits. Consequently, by varying the length of insertion of the tabs, there may be provided an adjustable gap between neighboring parts, which gap can be used for adjusting the dimensions of the cavity. In other words, being able to vary the length of the inserted (and bent) tab so as to adjust the distance between joined adjacent parts allows for a lighting assembly having increased dimensional tolerance range.

Thus, the present embodiment enables a more flexible and robust lighting assembly that can be used with lighting fixtures and/or grids of slightly various sizes.

According to an embodiment, at least one (and preferably all) of the first reflector, the second reflector and the at least two sidewall parts is formed by sheet material, such as a sheet metal. Sheet materials, and in particular sheet metals, are advantageous in that they may be cut and bent into a variety of shapes with relative ease. A further advantage is that they may be pre-painted during manufacture (before being coiled and sent to the lighting assembly manufacturer), this may bring cost reduction benefits. A sheet material may also allow for parts that are relatively stable and light weight, which may facilitate production and installation of a lighting assembly with an improved robustness and reliability. Further, a sheet material having relatively high heat conductivity may be used in order to provide a heat sink capable of dissipating heat energy generated by the light engine.

Alternatively the sheet material may be painted after manufacture. This may be more labour intensive and thus more expensive than using prepainted sheet material but it does ensure that the fixing locations remain paint-free. This may prove advantageous for electrically connecting the parts together to provide an earth connection.

According to an embodiment, the fixing may "bite' through the paint in order to provide an electrical connection. This may be achieved, for example, by the use of a serrated washer inserted between two parts or under the head of a bolt or screw fixing. When the fixing is tightened down, the washer will rotate with the fixing and the serrations will bite through the paint until a direct metal to metal connection is achieved. Advantagously, the washer is located between two parts and will bite into the painted surface of both of the parts and will provide a direct metal to metal connection via the serrated washer. Alternatively, the paint may be mechanically or chemically removed from the desired locations.

According to an embodiment, the use of stamping or folding tools may remove the paint at the required locations such that the electrical connection is achieved.

According to an embodiment, at least one of the support surfaces may be integrally formed with the first reflector, the second reflector and or the at least two sidewall parts. Thereby, a facilitated manufacturing process can be obtained, in which the support surface may be formed at the same time as the aforementioned parts are formed. This allows for a reduced number of steps and tools of the manufacturing process, as well as a reduced bill of material.

According to an embodiment, the light engine reflector is also formed with a support surface, this support surface may be a peripheral rim and may be used to facilitate the assembly of the lighting assembly. The support surfaces may have slots to allow a tab from the first reflector and the second reflector to pass through and to fasten the first reflector and the second reflector to the light engine reflector. In a preferable embodiment the at least two sidewall parts have tabs which are arranged to pass through further slots in the light engine first reflector and enable an even more rigid lighting assembly.

According to an embodiment, the light engine has a sprung plate at either end, these resilent plates extend away from the ends of the light engine when at rest but may be resiliently biased towards the light engine. The sprung plates are prefably identical to facilitate the light engine being fitted either either way round (end to end rotation).

The sprung plates may be mounted to the end panel of the light engine using a rivet, a screw, a nut and bolt, a quarter-turn fastener or any other fixing. The use of sprung plates means that installation of the light engine is simplified and furthermore, the opposing forces, which are preferably equal, will centralise the light engine between the opposing sidewall parts. This also means that the light engine can accommodate manufacturing tolerances of the lighting assembly which may affect the size of the opening in which the light engine is located.

In a preferred embodiment, the sprung plates may further comprise hook portions that engage with features on the at least two sidewall parts to provide an earthing connection between the sidewall parts and the light engine.

In an embodiment, two endcaps are fitted to the light engine to support a diffuser. These end caps may further comprise at least one opening to facilitate the releasing of the spring plates and the subsequent removal of the light engine or disassembly of the light assembly.

According to an embodiment, at least one of the support surfaces may be adapted to engage with (such as rest on) a frame arranged at a rim of the lighting fixture so as to support the lighting assembly at the lighting fixture. During assembly, at least one sidewall part may be arranged in the lighting fixture such that the support surface, and hence the at least one sidewall part, is resting on an upper surface of the frame. Thereby, the lighting assembly relatively easily and quickly can be mounted and supported in the lighting fixture. The frame may e.g. be a part of a grid (such as a cell of a grid) used as a support structure in a dropped ceiling.

The support surface may e.g. be arranged to engage with the frame such that the lighting assembly (at least almost) covers an opening defined by the frame, whereby any space or gap between the frame and the lighting assembly is reduced or even eliminated. Thereby, the space above the lighting assembly and/or lighting fixture may be hidden from a viewer observing the ceiling.

According to an embodiment, the support surface may comprise a protruding flange of the first reflector, the second reflector and/or the at least two sidewall parts. For example, an edge of the part may be folded so as to form the support surface. Thereby, a relatively robust and stable assembly is enabled, having a reduced risk of coming loose from the lighting fixture.

By adapting the configuration of the first reflector, the second reflector and/or the at least two sidewall parts, the illumination output may be controlled, or at least modified, so as to achieve an illumination having a desired beam angle, distribution, pattern, intensity etc. Further, the reflective surface of the first reflector, the second reflector and/or the at least two sidewall parts may improve the efficiency of the emitted light and reduce losses due to e.g. absorption in the cavity.

The reflective surface may be formed of a bulk material (i.e. the material of which the part is formed, such as e.g. a sheet metal) having a relatively high coefficient of reflection. The surface may also be provided by e.g. polishing of the material prior to forming the sidewall portion, prior to mounting the portions, and/or after the lighting assembly is installed. The reflective surface portion may also be provided by an at least partially light reflecting coating which may be applied prior to or after the first reflector, the second reflector and/or the at least two sidewall portions are formed. Such coating may also be applied after the lighting assembly is installed.

According to an embodiment, the light emitting element may comprise a LED. However, the term "light emitting element" may refer to any device or element that is capable of emitting radiation in any region or combination of regions of the electromagnetic spectrum, for example the visible region, the infrared region, and/or the ultraviolet region, when activated e.g. by applying a potential difference across it or passing a current through it. Therefore, a light-emitting element can have monochromatic, quasi-monochromatic, polychromatic or broadband spectral emission characteristics. Each light-emitting element may have at least one light source. Examples of light sources include semiconductor, organic, or polymer/polymeric light-emitting diodes (LEDs), blue LEDs, optically pumped phosphor coated LEDs, optically pumped nano-crystal LEDs or any other similar devices as would be readily understood by a person skilled in the art. Furthermore, the term light-emitting element can be used to define a combination of the specific light source that emits the radiation in combination with a housing or package within which the specific light source or light sources are placed. For example, the term light emitting element may comprise a bare LED die arranged in a housing, which may be referred to as a LED package.

It is noted that embodiments of the invention relates to all possible combinations of features recited in the claims. Further, it will be appreciated that the various embodiments described for the lighting assembly are all combinable with embodiments of the method as defined in accordance with the second aspect.

BRIEF DESCRIPTION OF THE DRAWINGS

These and other aspects will now be described in more detail with reference to the appended drawings showing embodiments, in which.

All the figures are schematic, not necessarily to scale, and generally only show parts which are necessary in order to elucidate the embodiments, wherein other parts may be omitted or merely suggested. Like reference numerals refer to like elements throughout the description.

DETAILED DESCRIPTION

The present aspects will now be described more fully hereinafter with reference to the accompanying drawings, in which currently preferred embodiments are shown. This invention may, however, be embodied in many different forms and should not be construed as limited to the embodiments set forth herein; rather, these embodiments are provided for thoroughness and completeness, and fully convey the scope of the present aspect to the skilled person.

Figure 1:
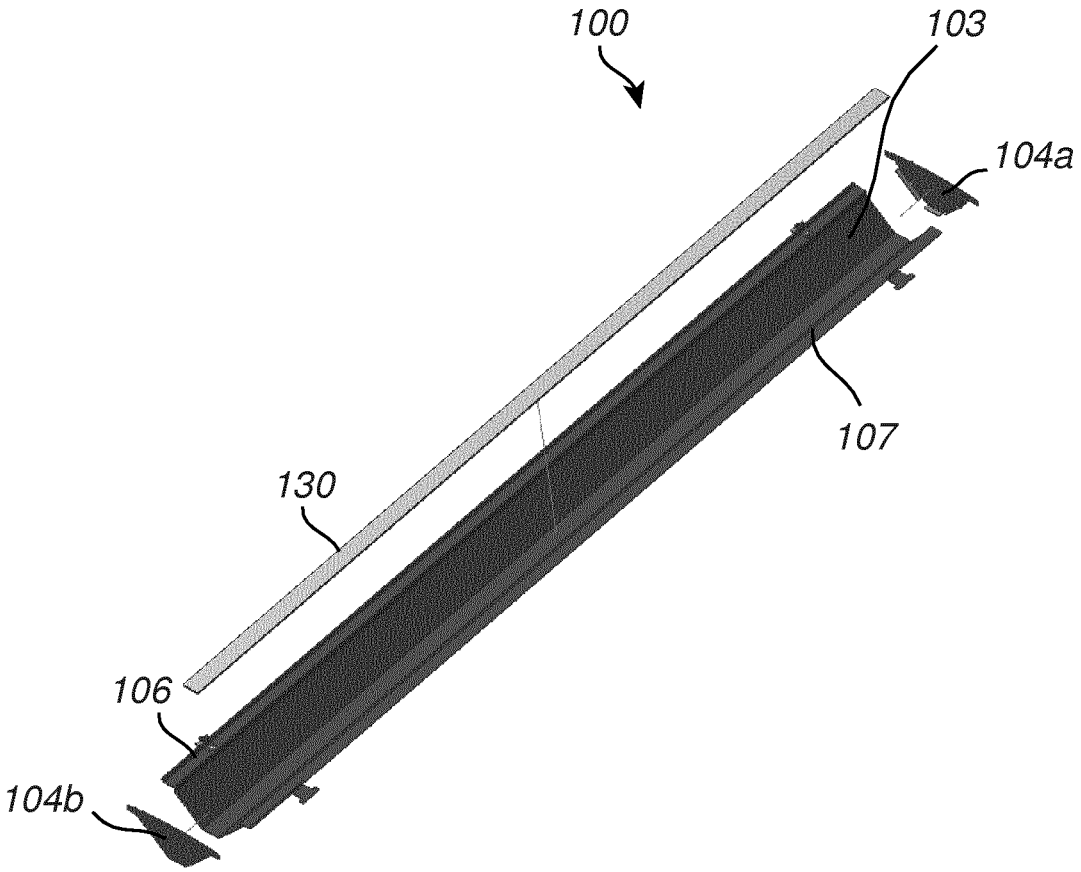
FIG. 1 is a bottom plan view of a light engine according to an embodiment.

With reference to FIG. 1, there is shown a bottom plan view of a light engine 100 according to an embodiment. The light engine 100 comprises a reflector 103, two end caps 104*a*, 104*b* and three light emitting elements 130. The reflector 103 is provided with a peripheral rim that is bent to form support surfaces, or protruding flanges 106, 107.

Figure 2:
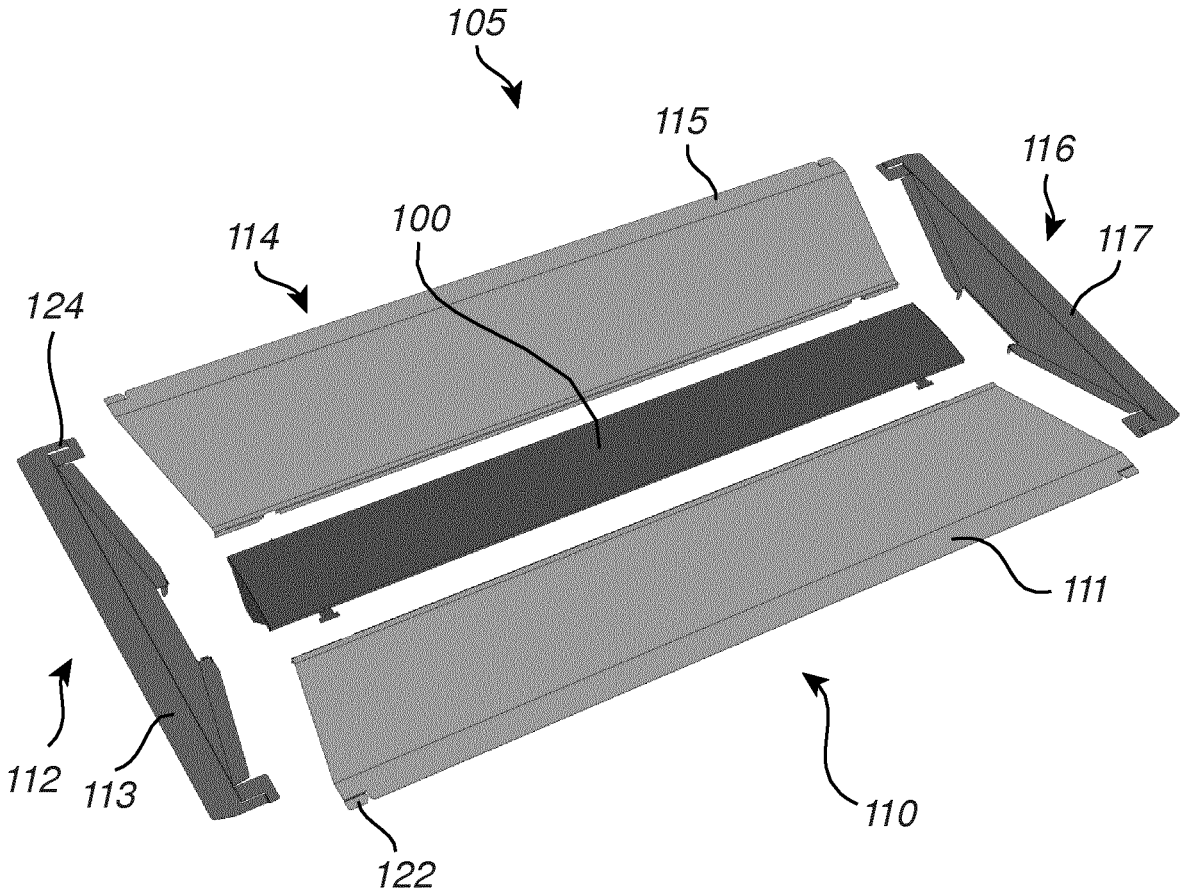
FIG. 2 is a bottom plan view unassembled lighting assembly according to an embodiment.

With reference to FIG. 2, there is shown an exploded bottom plan view of a lighting assembly 105. The lighting assembly 105 comprises a first reflector 110 and a second reflector 114, the first reflector and the second reflector are shown in a longitudinal direction, a first sidewall part 112 and a second sidewall part 116, the first sidewall part and the second sidewall part are shown in a lateral direction, fastening arrangements 122, 124, and a light engine 100.

The first reflector 110, second reflector 114, first sidewall part 112 and second sidewall part 116 are formed of a sheet metal that is cut and bent into the desired shape. As shown in FIG. 2, the first reflector 110 and the second reflector 114 are in a longitudinal direction and are secured to the two sidewall parts 112, 116 (located in a lateral direction) by means of the fastening arrangements 122, 124 so as to form a four-sided cavity. In this embodiment, each first reflector 110, second reflector 114, first sidewall part 112 and second sidewall part 116 represents a sidewall of the cavity, wherein the light engine 100 forms a top wall, or roof, of the cavity. The first reflector 110, second reflector 114, first sidewall part 112 and second sidewall part 116 are provided with a peripheral rim that is bent (the fold is indicated by dashed lines in the figure) to form support surfaces, or protruding flanges 111, 113, 115, 117. In other words, each one of the first reflector 110, second reflector 114, first sidewall part 112 and second sidewall part 116 may be described as a flat sheet metal piece that has been bent into an essentially plain portion forming a side of the cavity and a protruding flange 111, 113, 115, 117 adapted to support the lighting assembly 105 in a lighting fixture (not shown). However, it will be appreciated that the first reflector 110, second reflector 114, first sidewall part 112 and second sidewall part 116 may be formed of other material, such as e.g. polymers, by other techniques, such as e.g. injection molding, and into other shapes, such as e.g. a curved profile. Further, the dimensions of the first reflector 110, second reflector 114, first sidewall part 112 and second sidewall part 116 may be adapted to fit into wide variety of lighting fixtures and grids 160 of various widths and lengths.

According to the embodiment as shown in FIG. 2, the three light emitting elements 130 (e.g. LEDs), are arranged on the light engine 100. The LEDs 130 may e.g. be preassembled on the light engine 100 in order to facilitate and speed up the installation of the lighting assembly 105.

The first reflector 110, second reflector 114, first sidewall part 112 and second sidewall part 116 are adapted to be assembled upon insertion of the lighting assembly 105 in the lighting fixture and secured to each other by means of the fastening arrangement 122, 124. The fastening arrangement 112, 124 may comprise protruding members, such as tabs 122 that are integrally formed with e.g. the first sidewall part 112, second sidewall part 116, and receiving members, such as slits 124 that are cut out from the first reflector 110 and second reflector 114. The tabs may e.g. be formed by cutting and bending as the first sidewall portion 112 and second sidewall portion 116 are formed. Similarly, the slits 124 may be cut out during manufacturing of the first reflector 110 and the second reflector 114. The slits 124 may have a shape, or geometry, that corresponds to a cross section of the tabs 122 in order to allow the tabs 122 to be inserted through the corresponding slits 124. Further, the tabs 122 may be adapted to be deformed after being inserted through the slits so as to fix the first reflector 110, first sidewall 112, second reflector 114 and second sidewall 116 to each other. The tabs 122 may e.g. be plastically deformed by bending, folding or wrenching into a shape that prevents the tabs from being loosened from the slits. Alternatively or additionally, the protruding members may be secured to the receiving members by other means, such as e.g. clenching, gluing, screwing, etc.

When the first reflector 110, first sidewall 112, second reflector 114 and second sidewall 116 are secured to each other, they are arranged such that a peripheral portion of a first reflector 110, first sidewall 112, second reflector 114 and second sidewall 116 meets a peripheral portion of another one of the aforementioned parts, thus forming a junction between the first reflector 110, first sidewall 112, second reflector 114 and second sidewall 116 that is arranged at one of the four corners of the cavity.

As each of the four flanges 111, 113, 115, 117 may be arranged to engage with e.g. the lighting fixture or a grid of a dropped ceiling, all four sides of the lighting assembly 105 may be supported in the lighting fixture. However, the lighting assembly 105 may comprise only two or three support surfaces. In case only two support surfaces are provided, each support surface may be arranged at different sides of the four-sided cavity, such as at opposing sides, so as to make the fixation of the lighting assembly 105 more stable. As an example, the first reflector 110 and second reflector 114 may be provided with support surfaces whereas the first sidewall part 112 and second sidewall part 116 may not.

Figure 3:
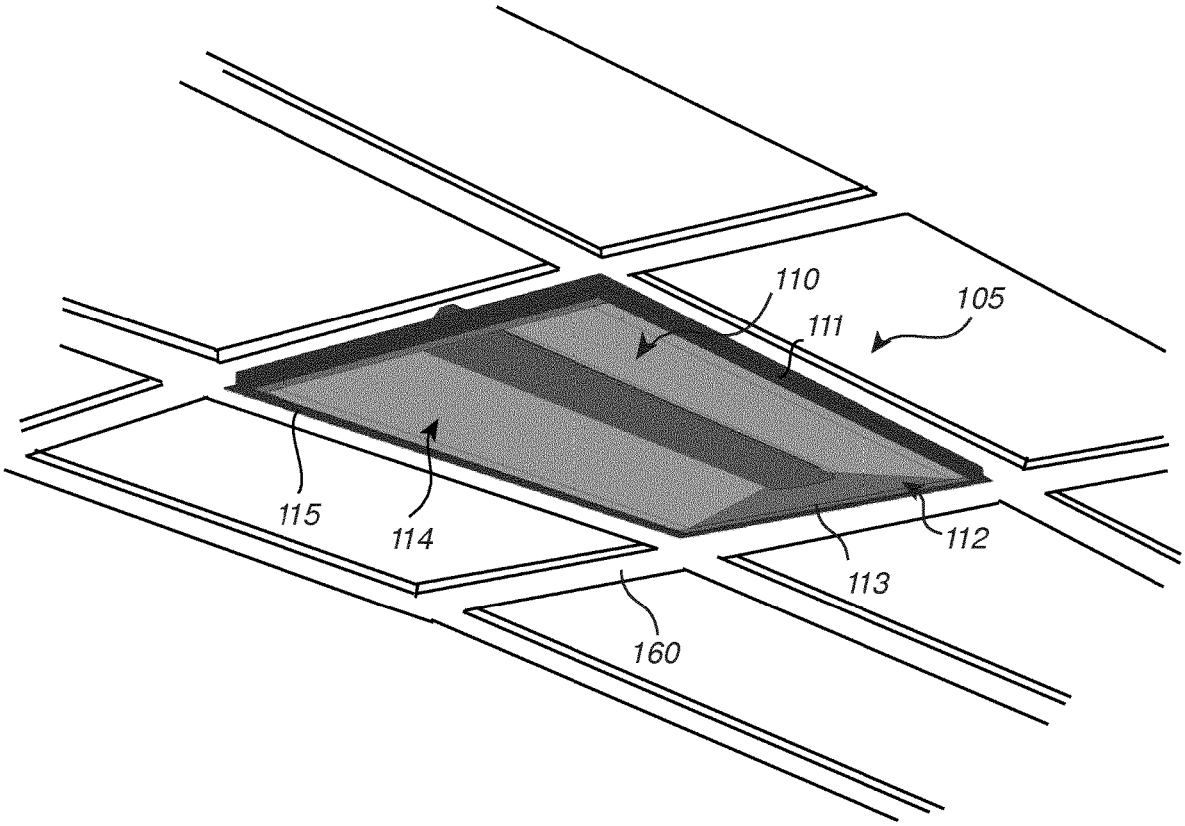
FIG. 3 is a bottom plan view of an assembled lighting assembly according to another embodiment.

FIG. 3 shows a bottom plan view of an assembled lighting assembly 105 according to another embodiment. The lighting assembly 105 may be similarly configured as the lighting assembly 105 described with reference to FIG. 2, but according to this embodiment, each of the first sidewall 112 and second sidewall 116 are provided with a recess 118 for receiving a protrusion 119 of the light engine 100, respectively. By arranging light emitting elements, such as LEDs 130, on the protrusion, the LEDs 130 may be positioned closer to the lateral side of the cavity. Thereby, the light emitted out of the cavity may be better distributed along the longitudinal extension of the lighting assembly 105. However, it will be appreciated that the placement of the light emitting elements 130 by no means is limited to the light engine 100, further light emitting elements 130 may be arranged on any part of the first reflector 110, first sidewall part 112, second reflector 114 and second sidewall 116. Consequently, any of the first reflector 110, first sidewall 112, second reflector 114 and second sidewall 116 may be provided with a recess 118 adapted to receive a protrusion 119 from any other of the aforementioned parts or the light engine 100 in order to provide a desired distribution of the emitted light.

In FIG. 3, the outline of a grid 160 of a dropped ceiling is indicated to illustrate an example of a lighting assembly 105 being supported by four flanges 111, 113, 115, 117 on the grid 160. The dimensions of the flanges 111, 113, 115, 117 may be adapted to (at least almost) fully cover the gaps between the lighting assembly 105 and the grid 160 or lighting fixture. The first reflector 110, first sidewall 112, second reflector 114 and second sidewall 116 are secured to each other by means of the tabs 122 of the first sidewall 112 and second sidewall 116 which engage with the slits 124 of the first reflector 110 and second reflector 114. As shown in FIG. 3, the tabs 124 may be bent or folded, after being fit into the slits 122, so as to prevent the first reflector 110, first sidewall 112, second reflector 114 and second sidewall 116 from coming loose from each other.

The first reflector 110, first sidewall 112, second reflector 114, second sidewall 116 and light engine 100 may be arranged in the lighting fixture one by one and subsequently secured to each other by the fastening arrangement 122, 124. Even though the mounted lighting assembly 105 may be slightly larger than e.g. the opening of the grid 160, the lighting fixture or the opening of a frame of the lighting fixture, the lighting assembly 105 may still be inserted in the lighting fixture by assembling the first reflector 110, first sidewall 112, second reflector 114, second sidewall 116 and light engine 100 one by one in the lighting fixture. As an example, the lighting assembly 105 in FIG. 3 is provided with circumferential flanges 111, 113, 115, 117, which due to the length and width of the lighting assembly 105 may render it difficult to insert a pre-mounted lighting assembly 105 in the grid 160. However, the lighting assembly 105 may be inserted in the lighting fixture in pieces or modules, such as first reflector 110, then first sidewall 112, then second reflector 114, then second sidewall 116, the light engine 100, which then may be secured to each other once they are inserted. As a result, a lighting assembly 105 having a circumferential periphery slightly larger than the opening in the grid 160, or a corresponding opening in the lighting fixture or in a frame arranged at the lighting fixture, can thereby be mounted in the lighting fixture.

Figure 4:
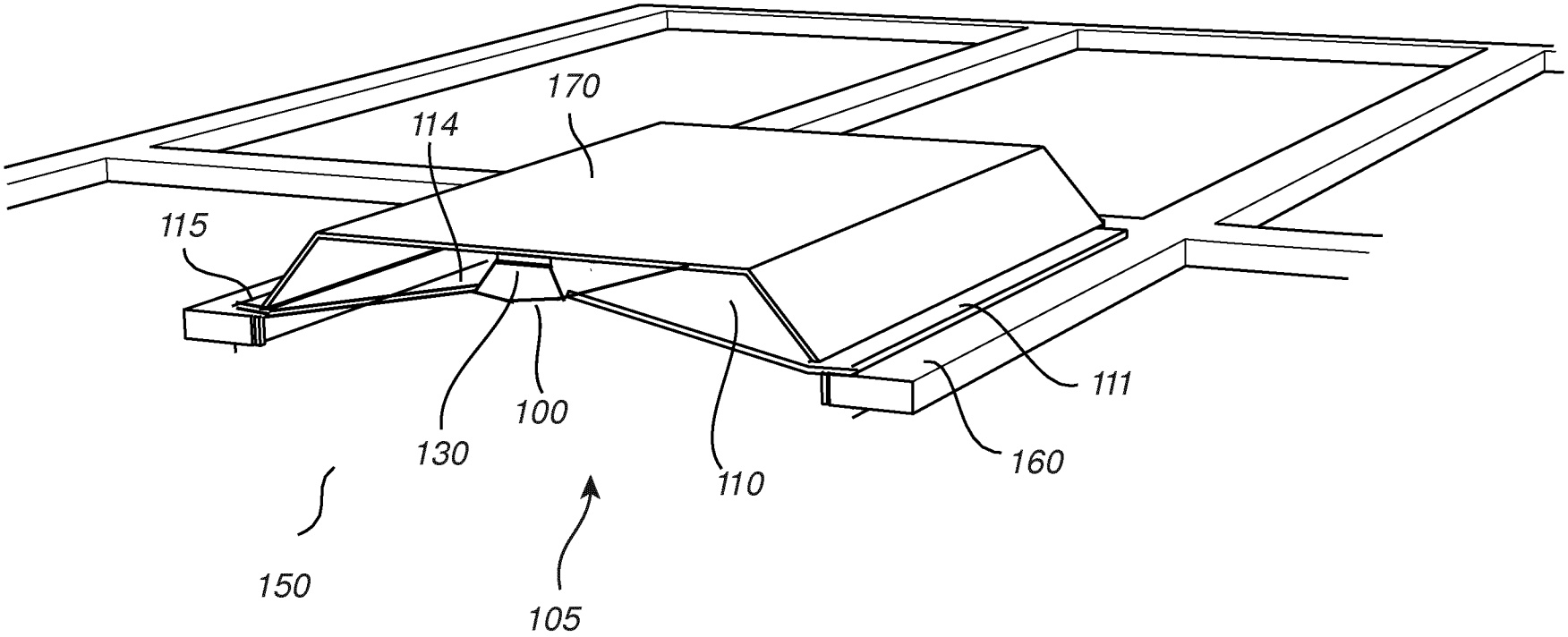
FIG. 4 is a cross sectional perspective view of a mounted lighting assembly.

FIG. 4 is a perspective, cross sectional view of a lighting assembly 105 similarly configured as the lighting assemblies 105 described with reference to FIGS. 2 and 3 mounted in a lighting fixture 170. The cross section of the lighting assembly 105 is taken across the first reflector 110 and second reflector 114 and shows a LED 130 arranged on reflector 103 of the light engine 100 to emit light within the four-sided cavity 140 defined by the first reflector 110, first sidewall part 112, second reflector 114 and second sidewall 116.

Each of first reflector 110 and second reflector 114 comprises a protruding flange 111, 115 which is adapted for supporting the lighting assembly 105 in the lighting fixture. As shown in FIG. 3, the flanges 111, 115 rest on the upper surface of a grid 160 of a dropped ceiling, in which the luminaire, comprising the lighting assembly 105 and the lighting fixture 170, is recessed.

Further, the embodiment of the lighting assembly 105 shown in FIG. 4 comprises a diffuser 150 arranged to diffuse the light emitted by the LEDs 130. The diffuser 150 may e.g. by secured to the reflector 103 of the light engine 100, the first reflector 110, the first sidewall 112, the second reflector 114 and/or the second sidewall 116 of the lighting assembly 105, the grid 160, or the lighting fixture 170. The fixation may e.g. be realized by means of protruding and receiving members similar to those previously discussed, or by fastening means such as clips, screws, etc, it may also be realized by the provision of snap fixing geometry. This geometry may be provided in an interupted manner or as a continuous feature around the periphery of the diffuser 150. The present diffuser 150 may e.g. be formed of a rectangular plate, it may be formed of a rectangular plate that is curved in one direction so as to conform with the envelope surface of a cylinder, or it may be formed in any preferred geometry. Thereby the diffuser 150 may be arranged to (at least almost) cover the LEDs 130 of the light engine 100 and hence improve the visual appearance of the lighting assembly 105. The diffuser 150 may also be slightly larger than the opening, or cell, defined by the grid 160 in order to partially or fully cover the opening of the cavity 140 such that neither the other parts of the lighting assembly 105 nor the lighting fixture 170 are visible to a viewer observing the ceiling. The diffuser 150 may be flat so as to provide a flat lower or inner surface of the ceiling.

Figure 5:
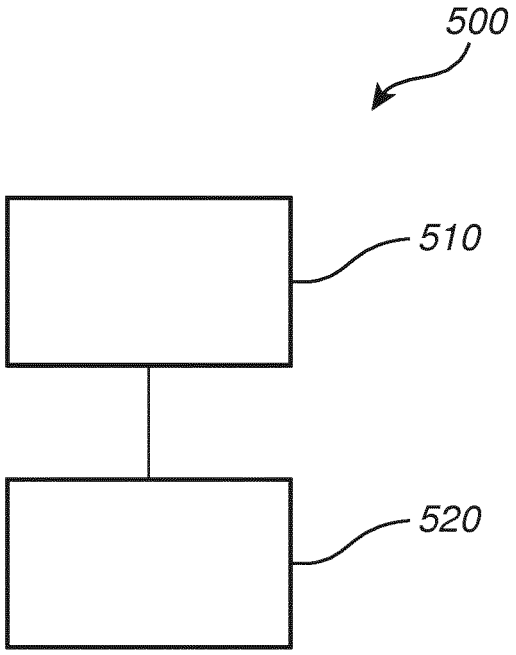
FIG. 5 is a schematic outline of a method for mounting a lighting assembly according to an embodiment.

A method 500 for mounting a lighting assembly in a lighting fixture according to an embodiment will be described with reference to FIG. 5. The lighting assembly 105 may be similarly configured as the lighting assembly 105 described with reference to FIGS. 1 to 3.

The method 500 comprises a step of arranging 510 the first reflector 110, the first sidewall part 112, the second reflector 114, the second sidewall part 116 and the light engine 100 in the lighting fixture 170, and a step of securing 520 the first reflector 110, the first sidewall 112, the second reflector 114, the second sidewall 116 and the light engine 100 to each other by means of a fastening arrangement 122, 124. When the first reflector 110, first sidewall 112, second reflector 114, second sidewall 116 and light engine 100 are secured to each other, they define sidewalls of a four-sided cavity 140 and junctions between the first reflector 110, first sidewall 112, second reflector 114 and second sidewall 116 are arranged at the corners of the cavity 140. Each one of at least two of the first reflector 110, first sidewall 112, second reflector 114 and second sidewall 116 comprises a support surface, such as e.g. a flange 111, 113, 115, 117, adapted to support the lighting assembly 105 in the lighting fixture 170. The support surfaces are arranged to be at different sides of the four-sided cavity 140 when the first reflector 110, first sidewall 112, second reflector 114 and second sidewall 116 are arranged in the lighting fixture, and may e.g. engage with a frame arranged at the lighting fixture 170 or a grid of a dropped ceiling.

Figure 6:
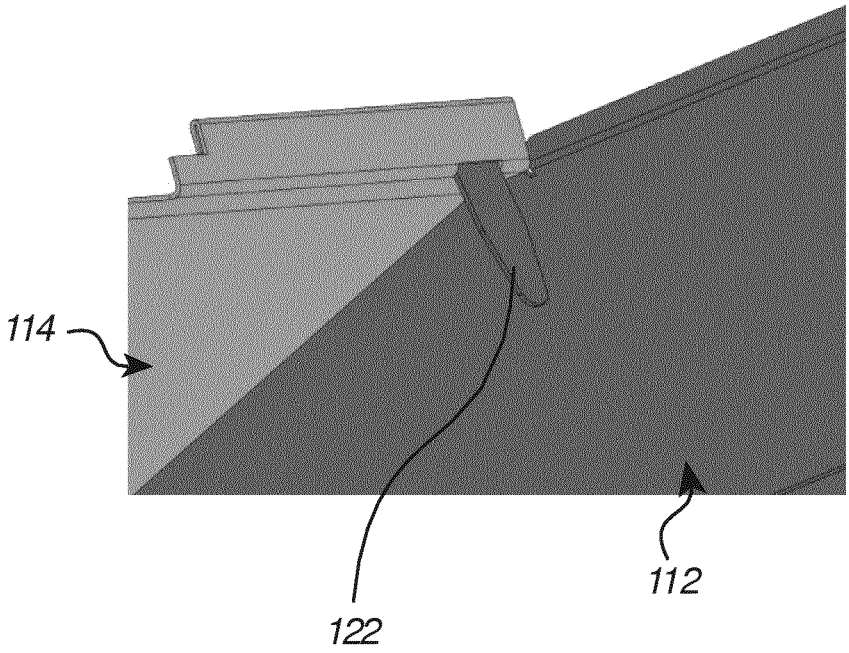
FIG. 6 is a close up view of a fixation between parts of the lighting assembly.

FIG. 6 shows a close up view of a fixation between the second reflector 114 and the first sidewall 112. The second reflector 114 comprises a slot through which a protruding member 122 (in this case exemplified as a tab) passes. The protruding member 122 protrudes from the first sidewall 122. Once the protruding member has passed through the slot, it may be bent such that dissambly cannot be carried out until the protruding member 122 has been straightened such that it may pass through the slot in the second reflector 114.

Figure 7:
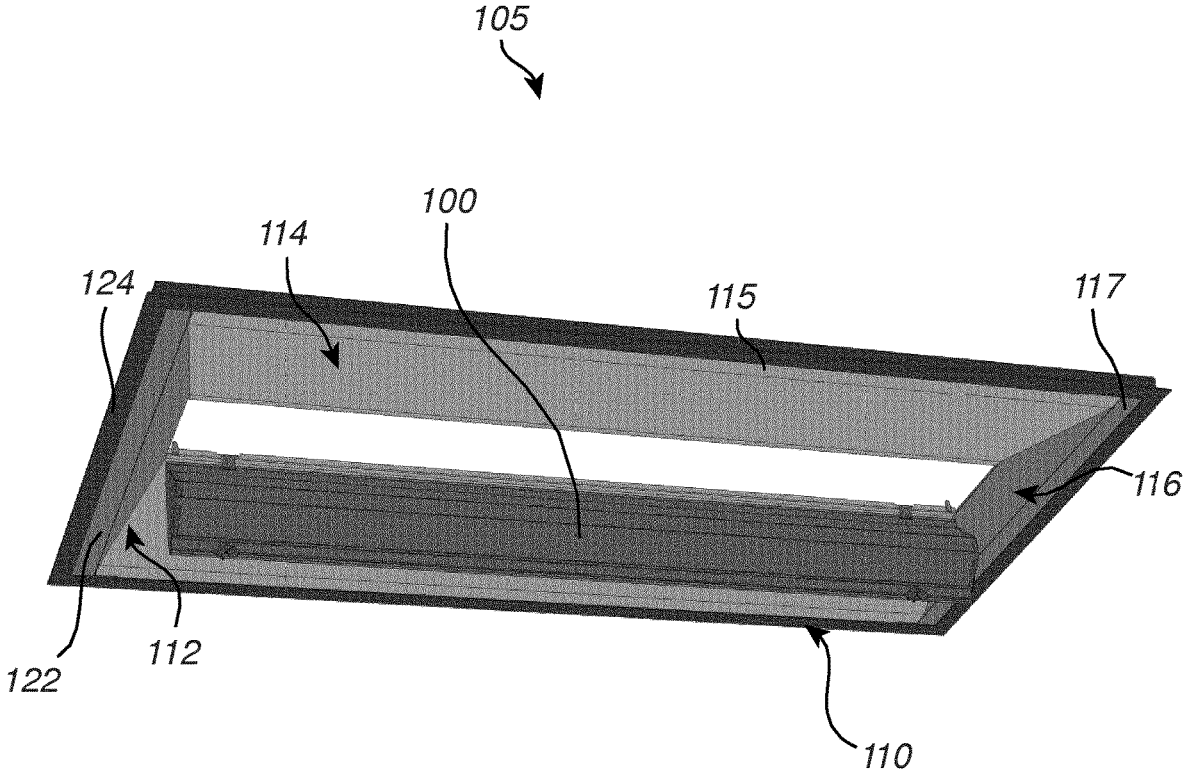
FIG. 7 is a bottom plan view of a partially assembled lighting assembly according to an embodiment.

FIG. 7 shows a bottom plan view of a partially assembled lighting assembly 105 wherein the light engine 100 has been hung using two hinges within the assembly. The driver (not shown) may be located at an angle from, and not directly attached to the light engine reflector 103. This angular location of the driver may ease the installation of the light engine 100 into the partially assembled lighting assembly. The angle of the mounting may be chosen such that when the light engine has been hung using at least one hinge within the assembly, the driver is arranged vertically. This may facilitate the easy connection of the driver to the existing wiring from the lighting fixture. The final stage is to rotate the light engine 100 such that it engages with the second reflector 114 and is affixed in position. The angular mounting may furthermore allow the easy rotation of the light engine around the at least one hinge as it reduces the instances wherein the driver impinges upon the back face of the first reflector 110.

Of course, any angle can be chosen for the driver mounting, it may be fitted directly to the rear of the light engine reflector 103 or it may be orientated such that when the light engine is hung using the at least one hinge the driver is arranged horizontally. The affixing of the light engine 100 to the second reflector 114 may be achieved in any manner of mechanical fixing methods such as, for example, a sprung clip (not shown).

The lighting assembly 105 according to the described embodiments may e.g. be a retrofit lighting assembly. Such retrofit lighting assembly may e.g. be used for modification or conversion of a luminaire already in use. As an example, a luminaire may be converted from an incandescent, fluorescent, or high intensity discharge light source into a LED light source.

The person skilled in the art realizes that the present invention by no means is limited to the preferred embodiments described above. On the contrary, many modifications and variations are possible within the scope of the appended claims. For example, the cavity 140 may be formed of more than the first reflector 110, first sidewall 112, second reflector 114 and second sidewall 116. The first reflector 110, first sidewall 112, second reflector 114, second sidewall 116 and light engine 100 may also be secured to each other by other fastening arrangements than those comprising a protruding member 122 and a receiving member 124. As an example, the first reflector 110, first sidewall 112, second reflector 114, second sidewall 116 and light engine 100 may be attached to each other by hook-and-loop fasteners, clips, adhesive tape, etc.

Additionally, variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting assembly comprising a light engine having at least one light emitting element and a reflector, wherein the lighting assembly further comprises;

a first reflector, a second reflector, at least two sidewall parts, a fastening arrangement adapted to secure the first reflector to at least one sidewall part, and a second fastening arrangement adapted to secure the second reflector to at least one sidewall part;

the first reflector, the second reflector and the at least two sidewall parts being adapted to be arranged in a lighting fixture and secured to each other such that they define sidewalls of a four-sided cavity;

the light engine being arranged to emit light out of said cavity; and junctions between the first reflector, the second reflector and the at least two sidewall parts are arranged to be at the corners of the four-sided cavity when the first reflector, the second reflector and the at least two sidewall parts are arranged in the lighting fixture and wherein the light engine reflector is mechanically connected to a first reflector, and a second reflector of the lighting assembly.

2. The lighting assembly according to claim 1, wherein each one of at least two of the first reflector, the second reflector and the at least two sidewall parts further comprises a support surface adapted to support the lighting assembly in the lighting fixture, the support surfaces being arranged to be at different sides of the four-sided cavity when the first reflector, second reflector and the at least two sidewall parts are arranged in the lighting fixture.

3. The lighting assembly according to claim 1 wherein the light engine is designed to structurally fix the first reflector and the second reflector of the lighting assembly.

4. The lighting assembly according to claim 1, further comprising a driver for providing electrical power to the at least one light emitting element, the driver being located at an angle from, and not directly attached to the light engine reflector.

5. The lighting assembly according to claim 1, further comprising a diffuser arranged to diffuse light emitted by the light emitting element.

6. The lighting assembly according to claim 5, wherein the diffuser further comprises snap fit features to affix to the light engine.

7. The light engine according to claim 1 wherein the light emitting element comprises at least one light emitting diode, LED.

8. The lighting assembly according to claim 1, wherein the fastening arrangement comprises at least one protruding member being integrally formed with at least one of the first reflector, the second reflector and the at least two sidewall parts and at least one receiving member being integrally formed with at least another of the first reflector, second reflector and the at least two sidewall parts, wherein the protruding member is adapted to engage with the receiving member so as to secure the first reflector, the second reflector and the at least two sidewall parts to each other.

9. The lighting assembly according to claim 8, wherein the protruding member comprises a tab and the receiving member comprises a slit, wherein the tab is adapted to be inserted in the slit and bent so as to secure the respective first reflector, the second reflector, and the at least two sidewall parts to each other.

10. The lighting assembly as defined in claim 8, wherein at least one of the first reflector, the second reflector or the at least two sidewall parts is formed by sheet metal.

11. The lighting assembly as defined in claim 8, wherein at least one of the support surfaces is integrally formed with the first reflector, the second reflector or the at least two sidewall parts.

12. The lighting assembly as defined in claim 8, wherein at least one of the support surfaces is adapted to engage with a frame arranged at a rim of the lighting fixture so as to support the lighting assembly at the lighting fixture.

13. The lighting assembly according to claim 12, wherein the support surface comprises a protruding flange of the first reflector, the second reflector or the at least two sidewall parts.

14. A method for mounting a lighting assembly as defined in claim 1, the method comprising:

arranging the first reflector, the second reflector and the at least two sidewall parts in the lighting fixture;

securing the first reflector, the second reflector and the at least two sidewall parts to each other by means of at the first fastening arrangement and the second fastening arrangement such that junctions between the first reflector, the second reflector and the at least two sidewall parts are arranged at the corners of the four-sided cavity, securing the light engine to the first reflector, arranging the light engine to connect with the second reflector, and securing the light engine to the second reflector.

15. The method for mounting a lighting assembly as defined in claim 14, the method further comprising;

securing the light engine to the first reflector using at least one hinge, and rotating the light engine such that it engages with the second reflector.

* * * * *